United States Patent [19]

Zeigler

[11] Patent Number: 4,637,180

[45] Date of Patent: Jan. 20, 1987

[54] CLIP FOR SELF-LOCKING COLLAPSIBLE/EXPANDABLE STRUCTURES

[76] Inventor: Theodore R. Zeigler, 9923 Indian Queen Point Rd., Oxon Hill, Md. 20022

[21] Appl. No.: 742,867

[22] Filed: Jun. 10, 1985

Related U.S. Application Data

[62] Division of Ser. No. 409,435, Aug. 19, 1982, Pat. No. 4,522,008.

[51] Int. Cl.[4] ..... B24B 7/00

[52] U.S. Cl. ..... 52/109; 403/170; 403/176; 446/121; 24/96; 24/113 R; 52/489; 52/646

[58] Field of Search ..... 52/645, 63, DIG. 10, 52/DIG. 13; 403/170, 171, 172, 176; 446/121, 109; 135/119, 115; 24/113, 96

[56] References Cited

U.S. PATENT DOCUMENTS

| | | | |
|---|---|---|---|
| 1,106,860 | 8/1914 | Bayton | 74/579 |
| 1,450,780 | 4/1923 | Olson | 74/579 |
| 1,472,536 | 10/1923 | Thomson | 52/DIG. 10 |
| 1,870,283 | 8/1932 | Crawford | 74/579 |
| 1,884,251 | 10/1932 | Robbins | 74/579 |
| 2,776,521 | 1/1957 | Zimmerman | 52/DIG. 10 |
| 2,885,822 | 5/1959 | Onanian | 446/121 |
| 3,481,634 | 12/1969 | Rondeau | 411/82 |
| 3,611,510 | 10/1971 | Bennett | 403/354 |
| 3,648,404 | 3/1972 | Ogsbury | 403/176 |
| 3,916,480 | 11/1975 | Smith | 16/383 |
| 3,968,808 | 7/1976 | Zeigler | 135/102 |
| 4,012,155 | 3/1977 | Morris | 403/360 |
| 4,028,855 | 6/1977 | Prewer | 52/DIG. 13 |
| 4,129,975 | 12/1978 | Gabriel | 403/171 |
| 4,159,592 | 7/1979 | Gabriel | 446/121 |
| 4,174,596 | 11/1979 | Deibele | 52/63 |
| 4,338,755 | 7/1982 | Chichester | 52/484 |
| 4,522,008 | 6/1985 | Zeigler | 52/109 |

FOREIGN PATENT DOCUMENTS

| | | | |
|---|---|---|---|
| 2611622 | 9/1977 | Fed. Rep. of Germany | 52/80 |

*Primary Examiner*—Carl D. Friedman
*Assistant Examiner*—Dan W. Pedersen

[57] ABSTRACT

This disclosure relates to a clip for securing together adjacent collapsible, expandable, self-locking, self-supporting structures which include a plurality of pairs of crossed rod elements pivotally joined in scissored fashion to each other and to hubs having openings therein, the structures having at least one hub of each section adjacent each other, and the clip having at least two stems with each stem being interlockingly received in an associated opening of the adjacent hubs to thereby secure the structures to each other in any one of a plurality of different configurations.

12 Claims, 34 Drawing Figures

FIG.7
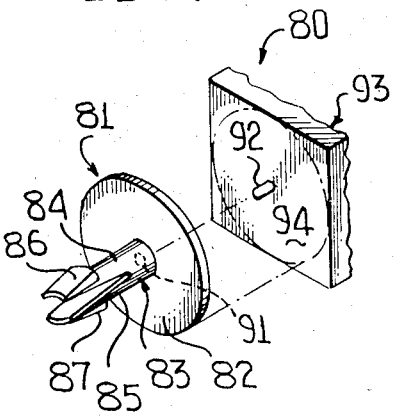
FIG.8
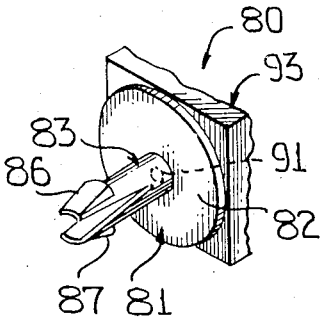
FIG.9
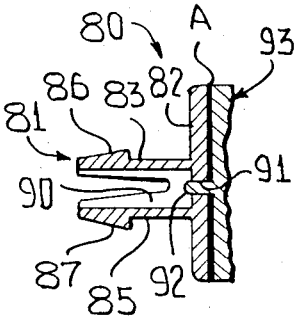
FIG.10
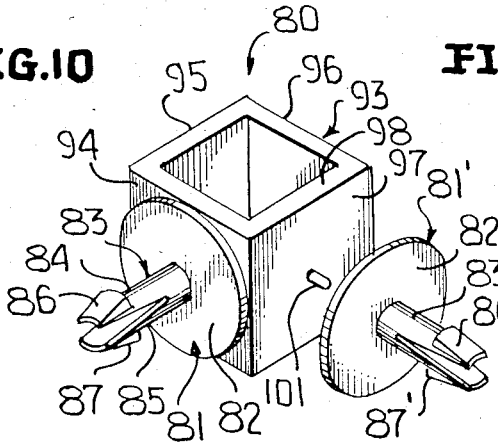
FIG.12
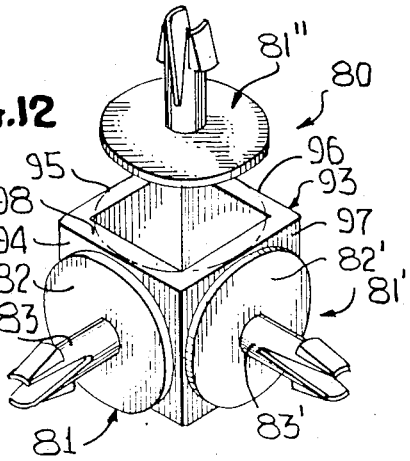
FIG.11
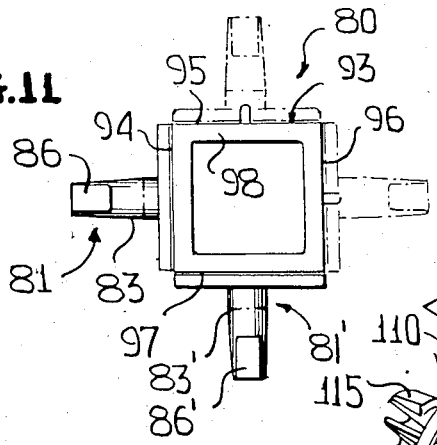
FIG.13
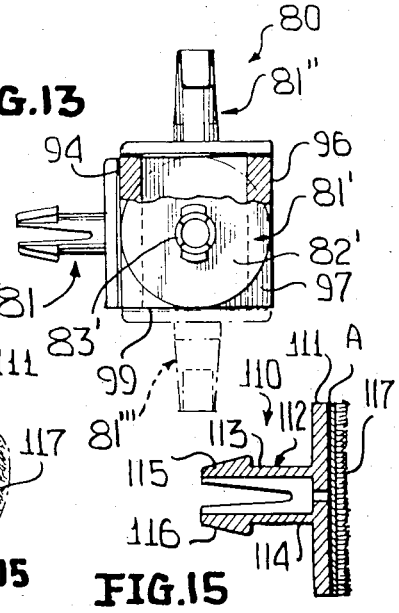
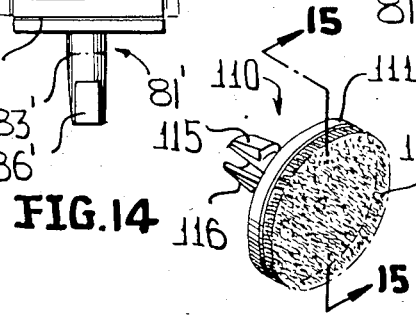
FIG.14
FIG.15

FIG.20
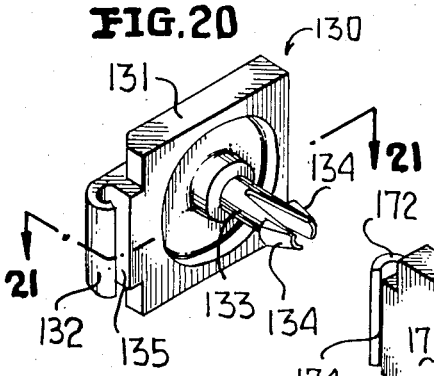
FIG.21
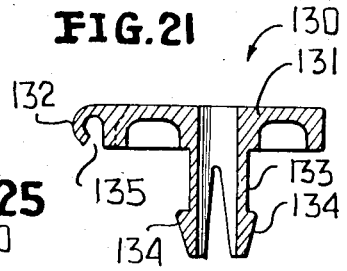
FIG.25
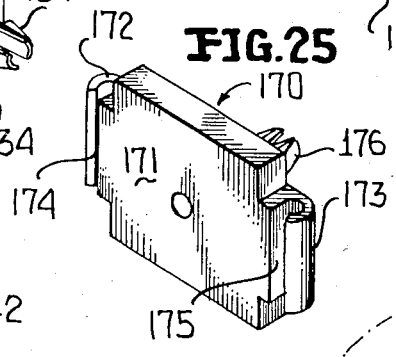
FIG.22
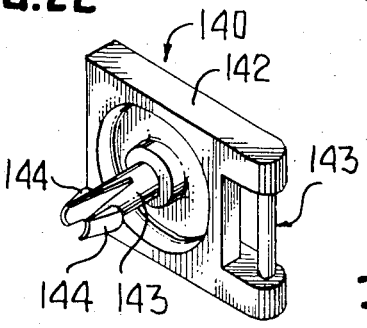
FIG.27
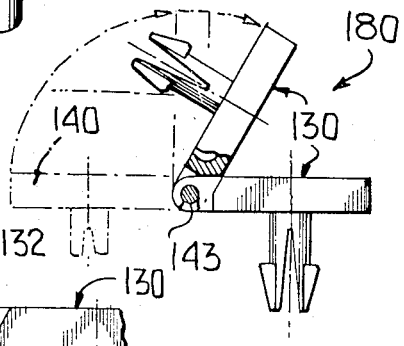
FIG.26
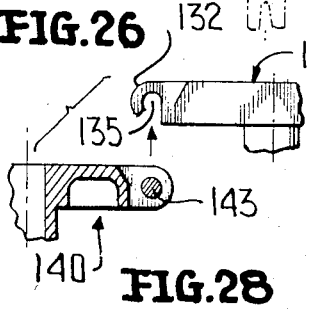
FIG.23
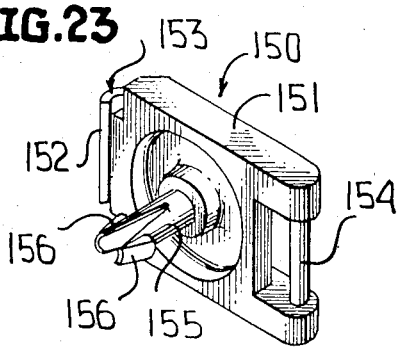
FIG.28
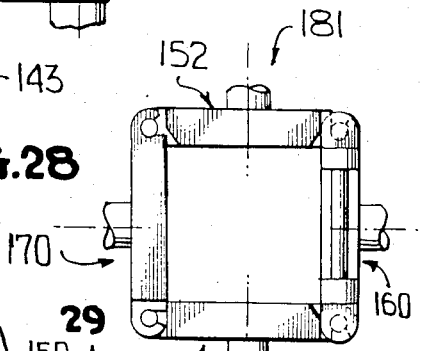
FIG.29
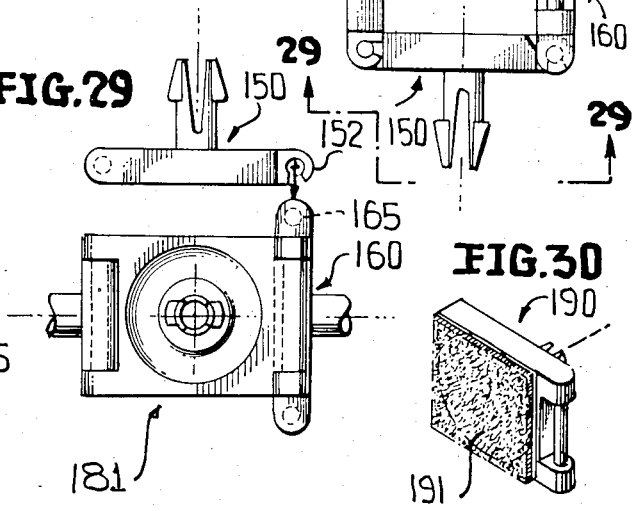
FIG.24
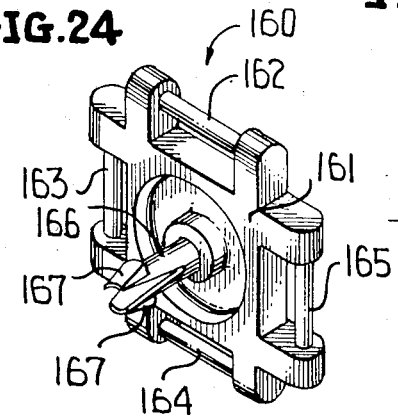
FIG.30

FIG.31
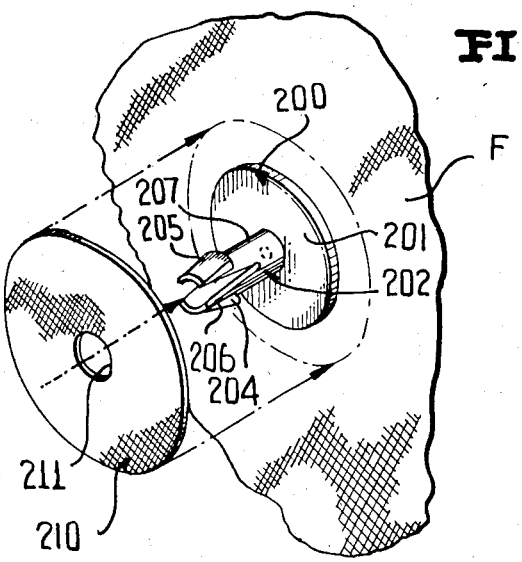
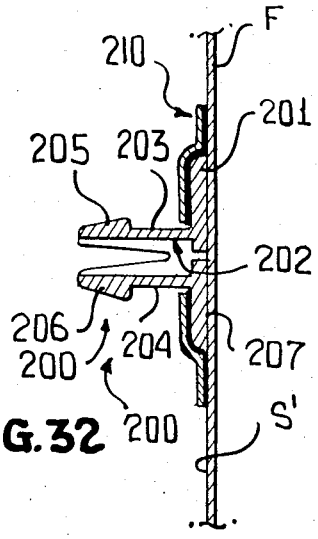
FIG.32
FIG.33
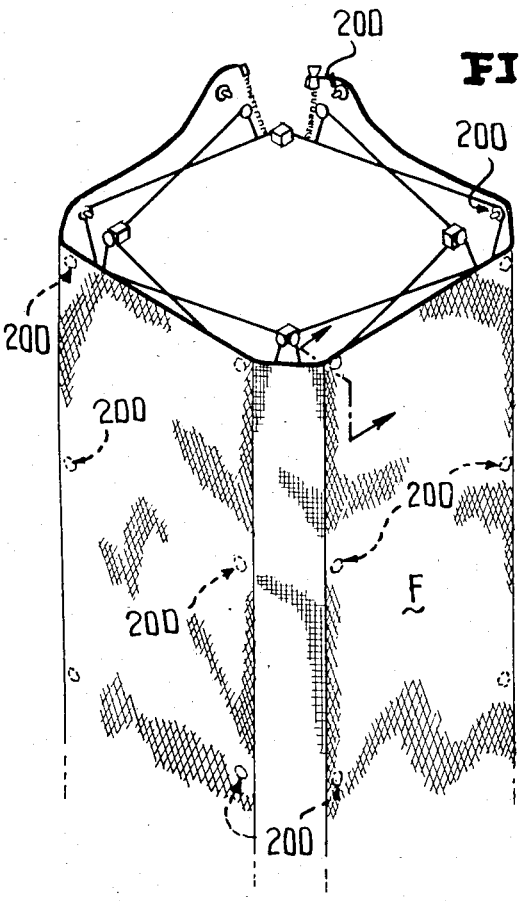
FIG.34
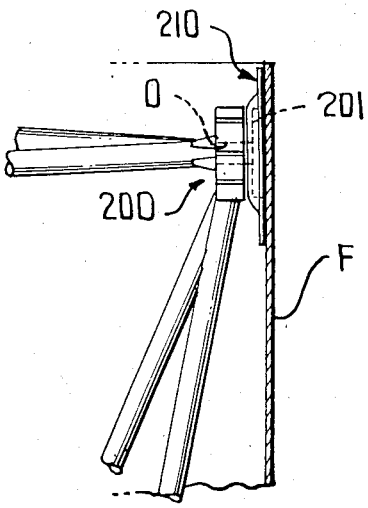

CLIP FOR SELF-LOCKING COLLAPSIBLE/EXPANDABLE STRUCTURES

CROSS REFERENCES TO RELATED PATENTS

The present application is a division of application Ser. No. 409,435 filed Aug. 19, 1982, now U.S. Pat. No. 4,522,008.

This application is related to the subject matter of U.S. Pat. Nos. 3,968,808; 4,026,313; 4,280,521 and 4,290,244 which issued on July 13, 1976; May 31, 1977; July 28, 1981 and Sept. 22, 1981, respectively, in the sense that the latter patents, all of which are in the name of Theodore R. Zeigler, are directed to collapsible, expandable, self-locking, self-supporting structures and/or display stands, their associated hubs and display panels. The application further relates to the subject matter of pending application Ser. No. 403,363 filed July 30, 1982, also in the name of Theodore R. Zeigler, for a display panel mounting clip, and now U.S. Pat. No. 4,512,097.

BACKGROUND OF THE INVENTION

In my aforesaid patents and application certain basic features of collapsible, expandable, self-locking and self-supporting structures are disclosed and the disclosures of such above-noted patents and application are incorporated herein by reference.

BRIEF SUMMARY OF THE INVENTION

The present invention is directed to means for securing together adjacent collapsible, expandable, self-locking, self-supporting structures, assemblies or sections of the type disclosed in the latter-noted patents and application whether of spherical shape, arch-like shape, planar, curved, etc., which can be readily collapsed and erected. Such structures generally include a plurality of sections of polygonal outline defined by pairs of crossed rods or rod elements which are selectively connected at ends thereof to hubs having holes or openings therethrough. The specific construction of the collapsible, expandable, self-locking, self-supporting structures and the manner in which the same can be erected or set up and collapsed are relevant herein only insofar as the invention disclosed and claimed herein is directed toward utilizing hubs of such structures, assemblies, sections thereof, stands or the like as connecting points utilizing clips for holding such structures one to the other in a particular relative configuration.

In accordance with the foregoing, the present invention can be utilized to, for example, form a column in which four separate collapsible, expandable, self-locking, self-supporting structures or assemblies are positioned with sides thereof adjacent each other to form a column of a square or polygonal configuration as viewed from above. The sides of adjacent assemblies have the hubs thereof generally contiguous each other and various ones of the novel clips of this invention can be used to secure the assemblies to each other by interlocking with the contiguous hubs. In this fashion, the clips hold the erected structures or assemblies in their column-like configuration so that individual display panels can be secured to individual sections of each assembly or structure or larger display sheets can be applied to partially or entirely cover the column. Like clips can be utilized to removably secure another section to the top of the column, thereby closing the same, and a variety of different configurations can be formed by simply using different clips and, of course, arranged in adjacent structures or assemblies in different relative relationships to each other. However, the significance of the present invention is the utilization of clips as releasable securing means in which the latter includes at least two stems with each stem being interlockingly received in an associated opening of the hubs of adjacent structures or assemblies or sections thereof such that such adjacent assemblies, structures or sections can be retained relative to one another in a desired position.

Thus, the present invention resides in a manner in which clips are utilized to connect together adjacent sections of self-supporting, self-locking structures or assemblies through the associated hubs thereof in the manner more specifically illustrated, described and claimed herein.

BRIEF DESCRIPTION OF THE DRAWING FIGURES

FIG. 7 is a fragmentary perspective view of a portion of the clip as shown in FIG. 4, and illustrates the manner in which a basic component of the clip is secured to an element by aligning a projection of the element with an opening or recess formed in a disc-like body having a projecting bifurcated stem.

FIG. 8 is a fragmentary perspective view of the securing means or clip of FIG. 7, and illustrates the body adhered to the element to form the clip.

FIG. 9 is a fragmentary sectional view taken through the axis of the stem and projection of the clip of FIG. 8, and illustrates the manner in which the projection is received in the opening of the clip body.

FIG. 10 is a perspective view of the clip showing the element thereof as a multi-sided cube to which another disc and stem member can be bonded.

FIG. 11 is a top plan view of the clip of FIG. 10, and illustrates the two stems projecting from the clip element at 90° to each other, and in phantom outline two additional possible stem positions.

FIG. 12 is a perspective view of the same clip of FIGS. 10 and 11 showing another possible position of another stem with the three stems then being all normal to each other.

FIG. 13 is a fragmentary side elevational view of the clip of FIGS. 10 through 12 illustrating in phantom outline another possible stem position.

FIG. 14 is a perspective view of the basic clip illustrating its disc-like body, its bifurcated stem, and Velcro fastening means adhered to the body.

FIG. 15 is a cross-sectional view taken generally along line 15—15 of FIG. 14, and illustrates details of the basic clip.

FIG. 20 is a perspective view of another clip of this invention, and illustrates the manner in which a body of the clip has a hook or pivotal connecting means along one edge thereof.

FIG. 21 is a cross-sectional view taken generally along line 21—21 of FIG. 20, and illustrates details of the clip including its hook and bifurcated stem.

FIG. 22 is a perspective view of another clip of this invention, and illustrates connecting means in the form of a pintle along an edge of the clip body adapted to be secured to the hook of the clip of FIGS. 20 and 21.

FIG. 23 is a perspective view of another clip of this invention, and illustrates of hook and a pintle at opposite edges of a body thereof.

FIG. 24 is a perspective view of another clip of this invention, and illustrates four edges of the clip body each carrying a pintle.

FIG. 25 is a perspective view of another clip of the invention, and illustrates two edges of a clip, each having a hook opening in the same direction.

FIG. 26 is a fragmentary perspective view partially in cross-section of the clips of FIGS. 20 and 22, and illustrates the manner in which the hook and pintle are engaged to form a pivotal connection therebetween.

FIG. 27 is a view similar to FIG. 26 of the same elements after being pivotally interconnected, and illustrates the manner in which the bodies of the clip can be moved between a variety of angles.

FIG. 28 is a top plan view of a clip formed from pivotally interconnecting the clips of FIGS. 23, 24 and 25.

FIG. 29 is an end view taken generally along line 29–29 of FIG. 28, and illustrates the manner in which another basic clip, such as the clip of FIG. 23, can be pivotally secured to a top of the overall clip of FIG. 28.

FIG. 30 is a perspective view of the clip of FIG. 22, and illustrates Velcro fastening means bonded thereto.

FIG. 31 is a perspective view of the basic clip of the invention, and illustrates the manner in which the same is secured to a flexible sheet by an annular hot patch or seal.

FIG. 32 is an enlarged axial sectional view after the assembly of the elements of FIG. 31, and illustrates a body of the clip being sandwiched between the hot patch and flexible sheet.

FIG. 33 is a perspective view of the column-like structure of FIG. 1, and illustrates the manner in which the same may be totally encased by a sheet of flexible material by utilizing the clip of FIG. 32 engaged within hubs of the column-like structure.

FIG. 34 is an enlarged fragmentary sectional view taken generally along line 34—34 of FIG. 33, and illustrates the manner in which the clip of FIG. 32 secures the flexible fabric or screen to one of the hubs of the columnlike structure.

DETAILED DESCRIPTION OF THE DRAWING FIGURES

Figure 1:
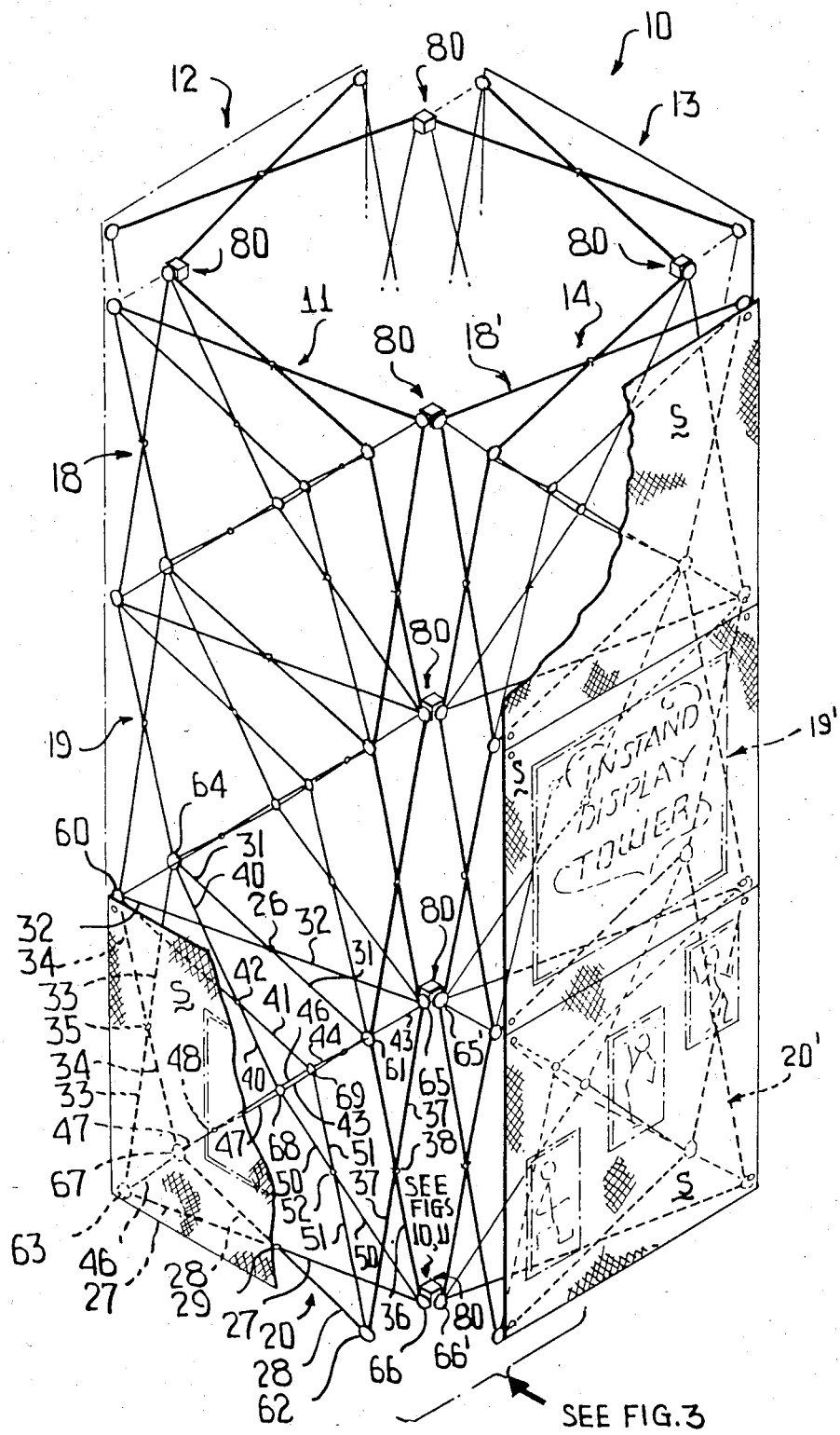
FIG. 1 is a perspective front elevational view of a plurality of adjacent collapsible, expandable, self-locking, self-supporting structures with each structure being formed of three sections defined by rod-like elements connected to hubs and with hubs of adjacent sections being connected together by clips of this invention.

Referring to FIG. 1, a novel collapsible, expandable, self-locking, self-supporting portable structure is illustrated and is generally designated by the reference numeral 10. The structure 10 is generally a hollow column having four vertical sides or assemblies 11, 12, 13 and 14. Each of the assemblies 11 through 14 includes three identical pivotally interconnected sections, such as the sections 18, 19 and 20 of the assembly 11. Since the sections 18 through 20 are identical, the following description of the section 20 will serve as a description for the remaining sections 18 and 19 of the assembly 11 as well as for the three unnumbered sections of the assemblies 12 and 13 and the sections 18', 19' and 20' of the assembly 14.

The section 20 includes a bottom horizontally disposed pair of crossed rods, rod elements or tubes 27, 28 pivotally connected at 29; a top pair of cross rods, rod elements or tubes 31, 32 likewise pivoted to each other at 26; a pair of vertical cross rods, rod elements, or tubes 33, 34 pivotally interconnected by a pivot pin 35, and another pair of vertical cross rods, rod elements, or tubes 36, 37 pivotally connected at a pivot pin 38.

Four other pairs of cross rods are also pivotally interconnected, the crossed rods, rod elements or tubes 40, 41 pivotally connected at 42; cross rods or tubes 43, 44 pivotally connected at 45; cross rods, rod elements, elements or tubes 46, 47 pivotally connected at 48 and cross rods, rod elements or tubes 50, 51 pivotally connected at 52.

Figure 3:
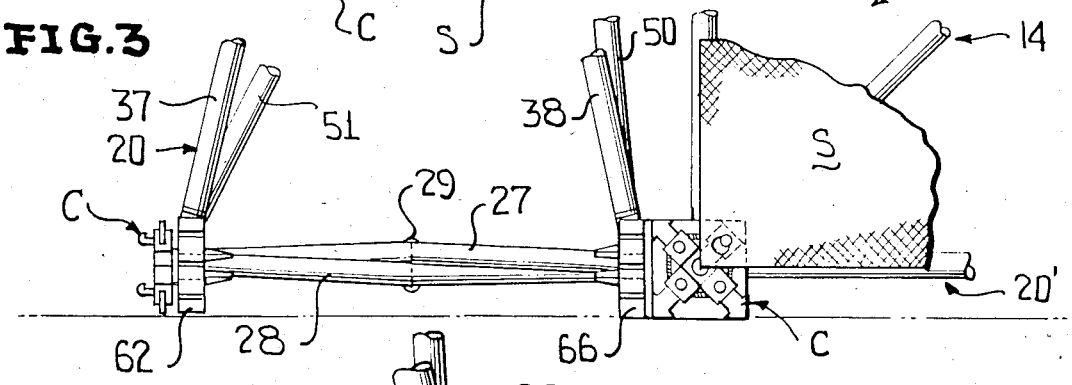
FIG. 3 is an enlarged fragmentary end elevational view of the lower corner of the structure shown in FIG. 1, and illustrates the manner in which two adjacent hubs of two adjacent sections are releasably interlockably secured together by a clip of this invention.
Figure 4:
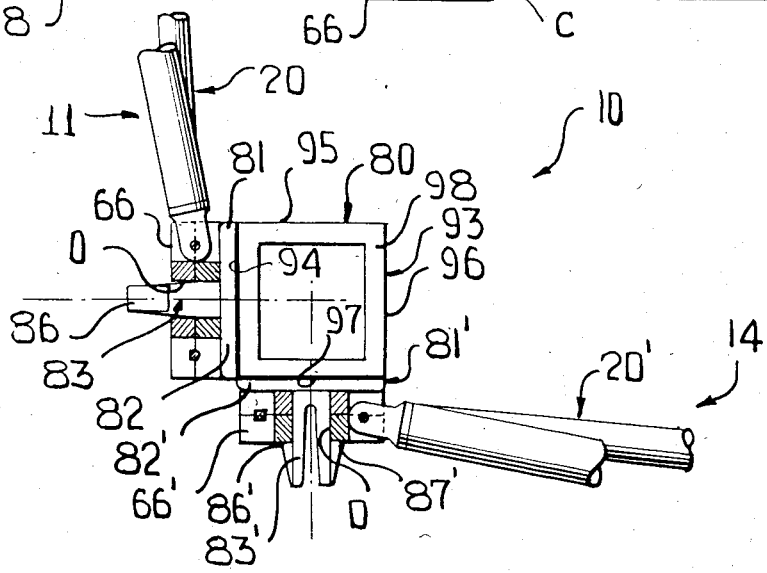
FIG. 4 is an enlarged view of the encircled portion of FIG. 2 with parts shown in cross-section for clarity, and illustrates the manner in which one of the clips or releasable securing means of this invention is connected by two stems into associated openings of adjacent hubs of adjacent sections.
Figure 5:
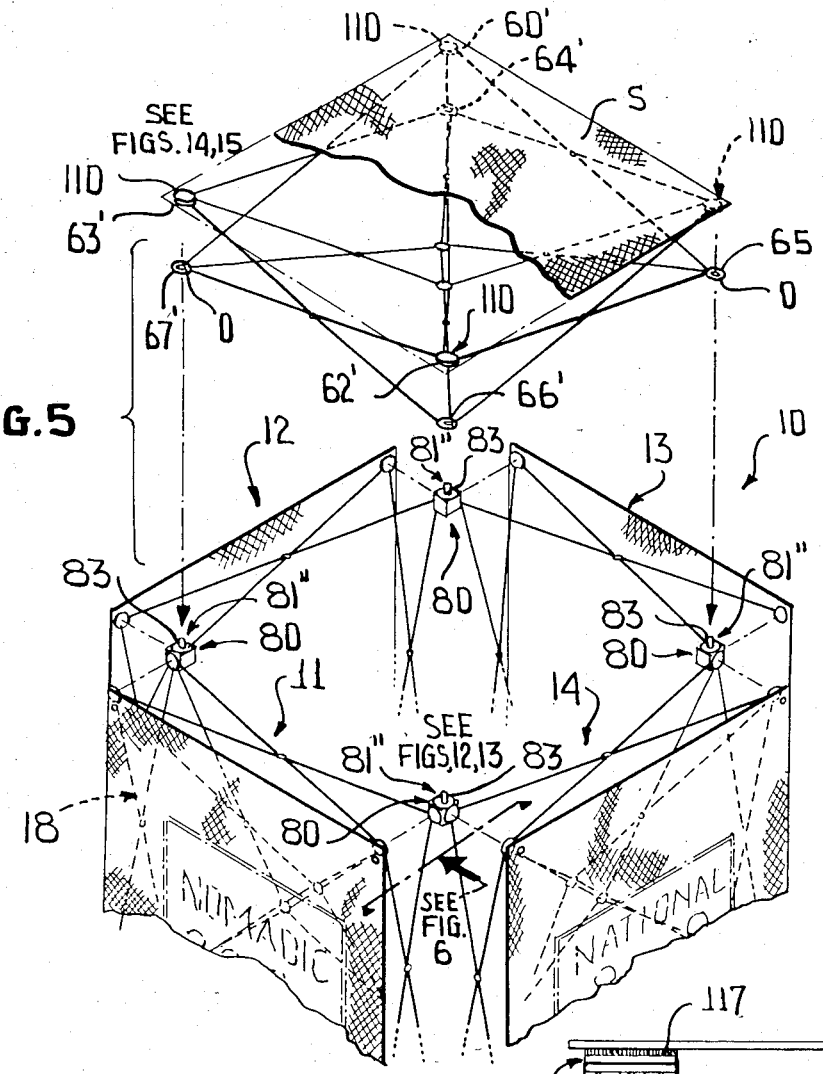
FIG. 5 is an exploded perspective view of an uppermost portion of the column-like assembly or structure of FIG. 1, and illustrates the manner in which an additional section can be secured by a clip of this invention as a cover to the column-like structure.
Figure 6:
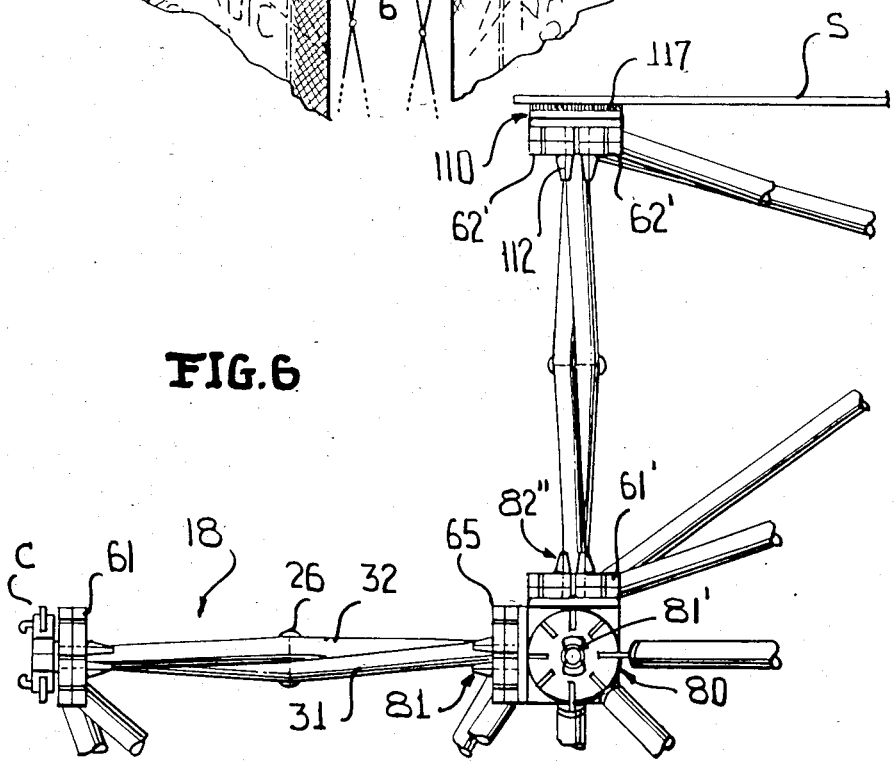
FIG. 6 is an enlarged fragmentary elevational view of the forwardmost corner of FIG. 5, and illustrates the manner in which the upper section is secured to one of the clips which also secures adjacent sections of adjacent hubs to each other.
Figure 16:
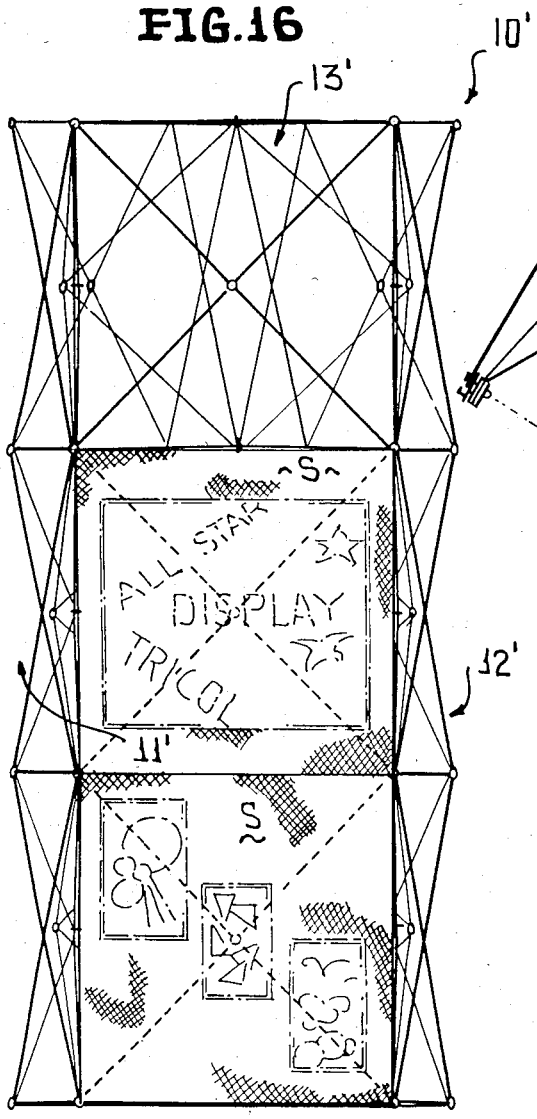
FIG. 16 is an end view of another column-like structure formed of three adjacent collapsible, expandable, self-locking, self-supporting structures or assemblies, and illustrates each assembly as being formed of three sections, associated crossed-rod elements, and associated hubs connected together by clips.
Figure 19:
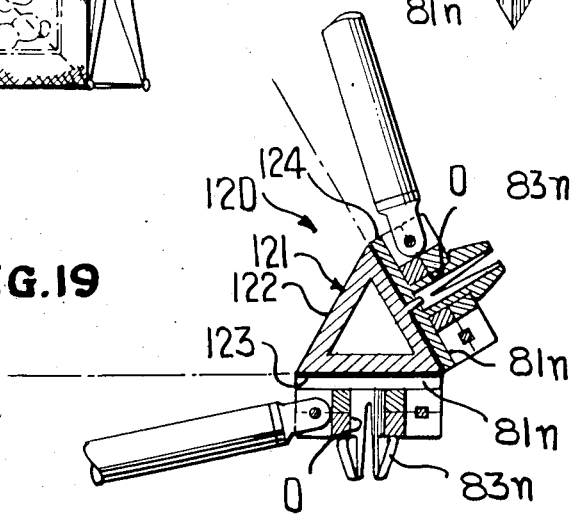
FIG. 19 is an enlarged cross-sectional view of the clip at the right-hand corner of FIG. 17, and illustrates the manner in which the two stems are received in openings of adjacent hubs of adjacent sections.

The rods are connected to associated hubs 60 through 69 with details of the construction of these hubs being best illustrated in FIGS. 4, 6 and 19 and U.S. Pat. No. 4,280,521 (FIGS. 3 and 5).

The hubs 60, 61, 62 and 63 lie in an essentially common plane in the erected condition of the section 20 as do the hubs 64, 65, 66 and 67. Thus, the planes of the hub 60 through 63 and 64 through 67 are generally spaced and in parallel relationship, as is most evident from FIG. 2 of the drawings. The hubs 60, 61, 62 and 63 are also in front and in axial alignment with the respective hubs 64, 65, 66 and 67. Similarly, the hub 68 is forward of and in axial alignment with the hub 69.

The rod elements 33, 34 are connected at their uppermost ends (FIG. 1) to the respective hubs 64, 60 and at their lower ends to the respective hubs 63, 67. Similarly, these rods 27, 28 are connected at their left ends (FIG. 1) to the respective hubs 63, 67 and to the hubs 66, 62, respectively, at the right-hand ends of these same rods.

The rods or rod elements 36, 37 are connected at their lower ends, again in FIG. 1, to the hubs 66, 62, respectively, and at their upper ends to the hubs 61, 65, respectively. Finally, the rods 31, 32 are connected at their left-hand ends to the hubs 64, 60 respectively, at the right-hand ends to the hubs 61, 65, respectively. The latter connections impart an overall generally polygonal or square-shaped configuration to the overall section 20 and, of course, to all of the remaining sections 18, 19, 19', etc., of the assemblies 11, 12, 13 and 14.

Turning now to the centermost or internal four pairs of cross rods which all have ends at the hubs 68, 69, the rods or rod elements 40, 41 are connected at their uppermost ends to the respective hubs 64, 60 and at their lowermost ends to the hubs 68, 69.

The rods 50, 51 are connected at their lowermost ends to the respective hubs 66, 62 and at their uppermost ends to the respective hubs 68, 69.

The rod elements 43, 44 are connected at their upper ends to the respective hubs 65, 61 and at their lower ends to the hubs 68, 69.

Finally, the rods 46, 47 are connected at their lower ends to the respective hubs 63, 67 and at their uppermost ends to the hubs 69, 68.

By virtue of the latter-noted construction of the section 20, the various rod elements heretofore described interact when the section 20 is moved from its collapsed to its erected position such as to place the section 20 under cumulative self-locking stress to hold the section 20, and the like sections 18 and 19 of the assembly 11, in its erected condition (FIG. 1). When the culumative self-locking stresses are released by essentially progressively manipulating the hubs 68, 69 to progressively spread the same further apart, the section 20 automatically releases, along with the sections 18 and 19, and all three sections of the assembly 11 collapse to their collapsed position, as is evident from the drawings in the latter-noted patents. Thus, each of the individual assemblies 11, 12, 13 and 14 can be individually erected and collapsed in a manner just described, and this invention is directed to novel means for releasably securing adjacent sections and/or the assemblies thereof to each other to form different overall composite structures, as, for example, the column structure 10 of FIG. 1.

The means for releasably securing the assemblies 11 through 14 to each other are operative through any one of the hubs 60 through 69, but particularly through adjacent hubs at the corners of the polygons, such as the hubs 60, 61, 62 or 63 of the forwardmost polygon of FIG. 1 or the rearmost polygon defined by the hubs 64, 65, 66 and 67. In FIG. 1, the hubs 65, 66 of the section 20 of the assembly 11 are shown being releasably secured by means, generally designated by the reference numeral 80 to respective hubs 65', 66' of an adjoining lowermost section 20' of the assembly 14. The primed reference characters/numbers indicate structure identical to the unprimed counterpart character/numbers.

Reference is now made to the more specific details of the releasably securing means 80 of FIGS. 2 through 10 of the drawings.

Each of the releasable securing means or clips 80 include a subassembly, clip or member 81 defined by a generally circular disc or disc-like body 82 and a stem 83 projecting therefrom (FIG. 7). The stem 83 is bifurcated to define a pair of stem portions 84, 85 (FIGS. 7 through 9) with each stem 84, 85 carrying releasable locking means in the form of a respective tapered lug 86, 87 which engage selected ones of the hubs 60 through 67 in the manner readily apparent from FIG. 4. Each of the hubs 60 through 67 has an opening O (FIG. 4) which receives the stem portions 84, 85, and during the insertion of these stem portions 84, 85 into the openings O, the stem portions 84, 85 normally deflect toward each other and then rebound to the position shown in FIG. 4 at which point the lugs 86, 87 lock in a releasable fashion to the associated hubs (66 and 66' in FIG. 4). In order to release each element 80, the stem portions 84, 85 are merely manually squeezed together until the lugs 86, 87 are free to pass through the opening O of an associated hub.

Each stem 83 includes an axial bore or opening 90 which registers with means 91 in the body 82 defining a recess or opening of the size corresponding to that of a projection 92 of an element 93 in part defining the clip 80. The element 93 may be of a number of different configurations but in the embodiment of the invention shown in FIGS. 7 through 13 of the drawings, the element 93 is multi-sided and includes faces or sides 94 through 97, a top face or side 98 and a lower face or side 99 (FIG. 13). Each of the sides 94 through 97 has or may have one of the projections 92 projecting therefrom as, for example, another projection 101 projecting from the face or side 97 of the element 93 of the clip 80. The projection 101 is received in and, thus, provides a locating action with the opening (not shown) of a clip 81' corresponding to the opening 91 formed in the body 82 of the clip 81. Thus, the projections 92, 101 accurately locate the clips 81, 81' relative to the faces or sides 94, 97 of the element 93, and in FIGS. 10 and 12 the axes of the stems 83, 83' are disposed normal (90°) to each other. The bodies 82, 82' of the clips 81, 81' are bonded by an appropriate adhesive A (FIG. 9) to the associated faces or sides 94, 97.

Figure 2:
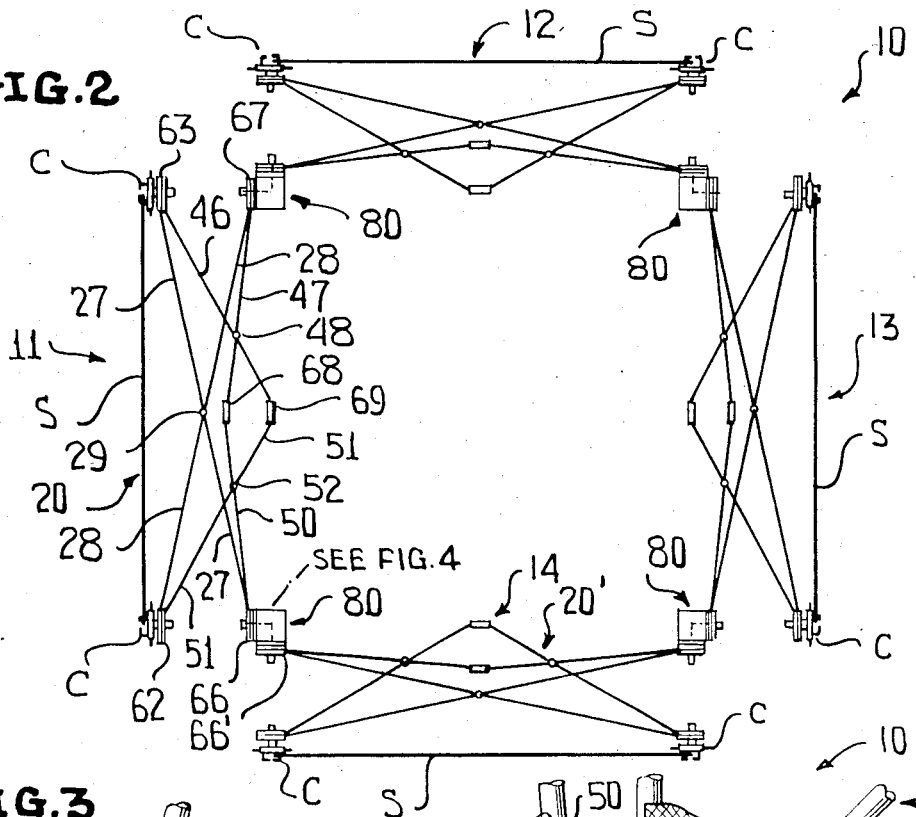
FIG. 2 is a horizontal sectional view through the lowermost four sections of the overall structure of FIG. 1, and illustrates the manner in which four of the assemblies are arranged in a generally polygonal configuration, as viewed from above, and are releasably connected at adjacent contiguous corners thereof.

Referring to FIG. 4 of the drawings, with the stems 83, 83' engaged in the openings O of the hubs 66, 66', the lowermost sections 20, 20' of the adjacent assemblies 11, 14 are releasably interlocked at these hubs. Corresponding clips or releasable fastening means 80 are likewise connected at adjacent corners of the lowermost sections of the assemblies 13, 14; 12, 13 and 11, 12, as is best illustrated in FIG. 2. Moreover, like clips 80 are provided at each adjacent corner to interconnect the hubs of adjacent assemblies, as is most readily apparent from FIG. 1, thereby rigidifying the entire column 10 while permitting the rapid uncoupling thereof by the removal of the clips 80 and the eventual collapsing of the individual assemblies 11, 12, 13 and 14.

Obviously, depending upon the particular configuration of various assemblies, such as the assemblies 11 through 14, the clip 80 can be modified in many different fashions beyond utilizing simply a single one of the clips 81 secured to the element 93. As was just described, two such clips 81, 81' can be secured to one of the elements 93 or an additional or two additional clips 81 can be secured to the element 93 so that three or four stems project from the sides of the element 93, as is indicated in solid and phantom outlines in FIG. 11. Obviously, since the element 93 is a cube, as many as six subclips 81, 81', etc., can be bonded thereto, one at each face or side 94 through 99, and in FIGS. 12 and 13 clips 81'' and 81''' are illustrated bonded to the respective faces or sides 98, 99, thus, placing the axes of the stems thereof in coincident relationship. The clip 80 of FIGS. 12 and 13 can, for example, be utilized in the manner best illustrated in FIGS. 5 and 6 of the drawings wherein each clip is shown connecting corners of the adjacent assemblies 11 through 14 to each other and with the stem 81' of each clip 80 projecting upwardly for receipt into an opening O of an associated hub (unnumbered) of a single section corresponding to the section 20 earlier described relative to FIG. 1. For simplicity, the hubs at the corners of the uppermost section (unnumbered) in FIG. 5 have been primed, and it is readily apparent from FIG. 5 that each stem 83 of the associated clip 81'' of the clip 80 will be received in the opening of an associated one of the hubs 64', 65', 66' and 67'. Thus, the single section will be disposed in a horizontal plane and may serve as a top or cover for the overall column-like structure 10, and, if desired, a rectangular sheet S may be applied thereto or to any of the sections, as is shown in FIGS. 1 and 5.

One way of securing the various sheets or panels S to the hubs 60 through 67 is by using display panel mounting clips of the type more specifically described, illustrated and claimed in application Ser. No. 403,363 noted heretofore and such clips are shown in FIGS. 2, 3 and 6 of the drawings and are generally designated by the reference character C. An alternative to the latter clip is a clip 110 (FIGS. 14 and 15) which includes a disc-like body 111 and a stem 112 projecting therefrom which is bifurcated to define stem portions 113, 114, each carrying respective locking lugs 115, 116. Adhesive A is used to bond a sheet of Velcro or similar fabric fastening means 117 to a side of the body 111 opposite that of the stem 112. One such clip 110 is positioned in the opening O of each of the hubs 60', 61', 62' and 63' (FIG. 5) after which the sheet S with the corresponding piece of Velcro or other compatible fabric fastening means secured at each corner has been adhered to the Velcro 116. Thus, the clips 80, 81, 81', 110, etc., are utilized both to interconnect various assemblies, as the assemblies 11 through 14 through their hubs not only in vertical planes, but also in horizontal planes (FIG. 5), and can also be utilized to adhere other materials thereto, as in the case of the clips 110 for securing the sheets, covers or panels S thereto (FIGS. 5 and 6).

Figure 17:
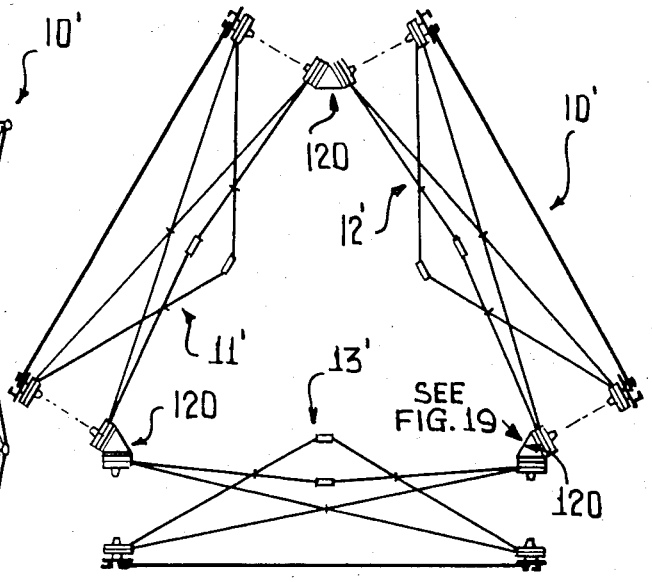
FIG. 17 is a top plan view of the column-like structure of FIG. 16, and illustrates another clip of this invention, whose stems are received in openings of the hubs of adjacent assemblies or sections to maintain the general triangular configuration of the column.
Figure 18:
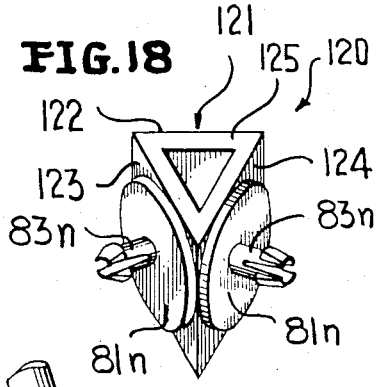
FIG. 18 is an enlarged perspective view of one of the clips of FIG. 17, and illustrates the manner in which the basic clip is adhered to an element of a triangular configuration.

While the clip 80 has been described thus far in maintaining the assemblies 11 through 14 in the generally column-like configuration of the structure 10, it is readily apparent that the clips 80 might be utilized to arrange any two or more of the assemblies 11 through 14 in a variety of other configurations as, for example, the assemblies 11 through 14 can simply be connected side-to-side so that they lie in essentially a common, though slightly offset vertical plane or wall. As another example, the clip of FIG. 11, including all four stems, could be utilized to retain the assemblies 11 through 14 in generally a crossed or X-shaped configuration, as viewed from above, but one limiting factor with the construction of the clip 80 is that stems thereof are disposed either normal to each other or coincident to each other, with no other variations being provided. With the latter in mind, reference is made to a clip 120 of FIGS. 18 and 19 which includes as a part thereof a generally triangular shaped element 121 having three sides or faces 122 through 124, an upper face 125 and a lower face (unnumbered). The angle set-off between each of the faces 122, 123; 122, 124; and 123, 124 is 60°. Clips **81*n*, identical to the clips 81, 81', 81'', etc., are bonded to the faces or sides 123, 124 and, thus, stems 83*n* thereof are disposed such that their axes include an angle of 120° and when positioned as shown in FIGS. 17 and 19 at, for example, corners of assemblies 11', 12' and 13', the resulting column 10' is of a triangular configuration as viewed in top plan (FIG. 17). The elements 120 are, of course, connected to the openings O of the associated hubs, just as in the manner heretofore described relative to the elements 80 and the hubs 65, 65'; 66, 66', etc. Thus, by altering the configuration of the element 121 of the clip 120, the various assemblies can be altered in a myriad of fashions, and this would also include adding clips 81*n* to the side 122, the upper side or face 125 and/or the lower (unnumbered) side or face of the element 121**.

In order to provide a more universal system than that thus far described, the clips 80, 81', 81'', 120, **81*n*, etc., can be formed in a variety of different ways, and and alternative structure to those heretofore described is shown in FIGS. 20 and 21. The clip of FIGS. 20 and 21 is generally designated by the reference numeral 130 and includes a generally rectangularly shaped body 131 having four edges (unnumbered) along one edge of which is means 132 in the form of a hook for forming pivotal connection means with associated clips, as will be described more fully hereinafter. It need but be noted that the clip 130 includes a stem 133 and associated lugs 134 identically to those heretofore described and, of course, that the hook 132 includes a slot 135 opening in the same direction as projects the stem 133**.

Another clip 140 is shown in FIG. 22, and the same includes a generally rectangular or square body 142 having four edges (unnumbered) along one of which are means 143 in the form of a pintle which forms pivotal connection means adapted to be snap-fit into a slot 135 of the hook 132 of the clip 130. The clip 140 likewise includes a stem 143 and locking lugs 144 associated therewith.

In FIG. 23 of the drawings, another clip 150 is shown having a generally rectangular or square body 151 along two edges of which there are pivotal connection means in the form of a hook 152 having a slot 153 and a pintle 154. Otherwise, the clip 150 includes a stem 155 and appropriate locking lugs 156 which function identically to that heretofore described.

Another clip 160 in FIG. 24 includes a body 161 of a polygonal or square configuration along four edges (unnumbered) of which there are located pivotal connection means in the form of four individual pintles 162 through 165. A stem 166 having locking lugs 167 projects from the body 161.

Another clip 170 (FIG. 25) includes a generally rectangular or square body 171 having four edges along two of which there are pivotal connection means in the form of hooks 172, 173 having respective slots 174, 175 opening in an identical direction opposite to that of a stem 176 identical to the various stems heretofore described.

FIGS. 26 and 27 illustrates a manner in which any one of the clips 130, 150 and 170 having hooks associated therewith can be connected to any one of the clips 140, 150, and 160 having a pintle. The hooks and pintles are simply snapped together in a manner clearly apparent from FIG. 26 in which the pintle 143 of the clip 140 is shown aligned with the slot 135 of the hook 132 of the clip 130. Once the two clips 130, 140 have been united, a composite clip 180 (FIG. 27) is formed and by pivoting the clips 130, 140 relative to each other, the same can be positioned to releasably interlock adjacent assemblies 11, 12, 13, 14, etc., in most any position desired, be it linear, aligned, planar or angles from acute to obtuse. Moreover, when the bodies 130, 140 are aligned, it should be apparent that the stems can project in the same direction or in opposite directions, depending, of course, upon the hooking direction which in FIG. 26 results in the stems being directed from the same side of the bodies 140, 130 but if the slot 135 is rotated to face upwardly to engage the pintle 143, then the stems of the bodies 130, 140 will be directed in opposite directions, and both modes are shown in FIG. 27. This provides not only a universal angular relationship between adjacent subclips 130, 140 of the overall clip 180 but also variations thereto to accommodate most any interconnection between two sections or any number of sections, be they disposed in exact vertical planar alignment, angular alignment, side-by-side, slightly offset, etc.

Variations in uniting the various clips 130, 140' etc., are possible as is evidenced by the composite clip 181 of FIGS. 28 and 29 which has been formed by assembling through their pivotal connections two clips 150, 150 (FIG. 28) in parallel relationship, two other clips 160, 170 also in parallel relationship, and a clip 150 (FIG. 29) secured by its hook 152 to the pintle 165 of the clip 160. The similarity of the composite clip 181 to the clip of FIG. 11 is apparent. The composite clip 181 is merely an example of a variety of different arrangements possible which, of course, can be utilized to interconnect the various assemblies 11, 12, etc., as might be desired.

A clip 190 of FIG. 30 corresponds identically to the clip 130, except Velcro 191 or like fabric fastening means has been adhered to the body (unnumbered) thereof, and like Velcro or similar fastening means 191 can be provided to the faces opposite the stems of the remaining clips for the purposes heretofore described relative to the panels or sheets S and the clips associated therewith particularly the clips 110 of FIGS. 5, 14 and 15 of the drawings.

The clips **80, 81, 81', 81*n*, 110, 130, 170, 180, 190, etc., can be used for purposes other than those already described, and the basic clip may also be adhered to a flexible fabric sheet F in the manner best illustrated in FIGS. 31 and 32. In this case, the clip is generally designated by the reference numeral 200 and includes a body 201 from which projects a stem 202 having a pair of bifurcated portions 203, 204 each of which includes respective locking lugs 205, 206. A surface or face 207 (FIG. 32) of the body 201 is positioned against a surface S' of the fabric F and an annular heat sealable patch 210 with an opening 211 is positioned as shown in FIG. 32 to sandwich the body 201 of the clip 200 between the heat sealable patch 210 and the surface S' of the flexible sheet F. Heat and pressure are then applied to the heat sealable patch 210 and the same is bonded to the body 201 and to the surface S', and with a plurality of the clips 200 so disposed at different positions along the fabric F, the same may be secured by the stem 202 to the column-like structure 10 in a manner best shown in FIG. 33 by simply introducing each stem into an opening O of an associated hub. In this fashion, the entire column can be draped or enclosed by one relative large fabric sheet F in lieu of individual panesl S, as is readily apparent from a comparison of FIGS. 1 and 33** of the drawings.

Although only a preferred embodiment of the invention has been specifically illustrated and described herein, it is to be understood that minor variations may be made in the apparatus without departing from the spirit and scope of the invention, as defined in the appended claims.

I claim:

1. A structure comprising a pair of adjacent separate, individual, collapsible and expandable sections, each section being formed of a plurality of pairs of crossed rod elements pivotally interconnected to each other through hubs having openings whereby said sections can be individually collapsed and expanded between two polygonal configurations of respective small and large sizes for respective storage/transport and use, releasable securing means for releasably securing one hub of one section to one hub of another adjacent section when said sections are of expanded large size, said releasable securing means including at least two stems with each stem being interlockingly received in an associated opening of said last-mentioned hubs, said releasable securing means also including a rigid multi-sided supporting element having at least two sides disposed at an angle to one another, first and second bodies each of which has opposite sides, said stems extending from one side of each of said bodies, each stem being at least bifurcated to define a pair of stem portions, each stem having means at the outer and thereof for releasably locking each of the stems to its associated hub by engaging a side of the associated hub remote from the body from which the stem extends, each of said bodies having an opening formed therein, each of said sides on the supporting element having a projection integral with and extending therefom, each of said projections being received within the opening of one of said bodies for locating said bodies such that each side of the supporting element is disposed adjacent the other side of one of said bodies, and bonding means fixedly securing each of said other sides to the adjacent side of the supporting element.

2. A clip as defined in claim 1 wherein each of said other sides are adhesively bonded to the adjacent side of the supporting element.

3. A clip as defined in claim 1 wherein each of said stems has an axial bore therethrough and each of said openings being in communication with and having an axis aligned with the associated bore.

4. A clip as defined in claim 1 wherein said releasable lockings means of each stem comprises a transversely extending lug at the outer end of each of said stem portions.

5. A clip as defined in claim 1 wherein each of said stems extends substantially normal to the side of the associated body.

6. A clip as defined in claim 1 wherein the axes of said stems are substantially normal to one another.

7. A clip as defined in claim 1 wherein the axes of said stems are coincident with one another.

8. A clip as defined in claim 1 wherein the axes of said stems are disposed at an obtuse angle to one another.

9. A clip as defined in claim 1 wherein said supporting element includes another side, a further body and stem identical to said first mentioned bodies and stems, and bonding means fixedly securing said further body to said another side of said supporting element.

10. A clip as defined in claim 9 wherein the axes of said stems are all normal to one another.

11. A clip as defined in claim 9 wherein the axes of at least two of said stems are coincident with one another.

12. A structure comprising a pair of adjacent separate, individual, collapsible and expandable sections, each section being formed of a plurality of pairs of crossed rod elements pivotally interconnected to each other through hubs having openings whereby said sections can be individually collapsed and expanded between two polygonal configurations of respective small and large sizes for respective storage/transport and use, releasable securing means for releasably securing one hub of one section to one hub of another adjacent section when said sections are of expanded large size, said releasable securing means including at least two stems with each stem being interlockingly received in an associated opening of said last-mentioned hubs, a body having opposite sides, a further stem projecting from one side of the body, said further stem being at least bifurcated to thereby define a pair of stem portions, said stem portions being adapted for receipt into an opening of one of said hubs, means for releasably locking said further stem to an associated hub by engaging a side of the hub remote from said body, a sheet of covering material, the opposite side of said body being disposed adjacent said sheet of material, an annular member having an opening receiving said further stem, said annular member overlying said body and said sheet to sandwich the body between said sheet and said annular member, and bonding means fixedly securing said annular member to said one side of the body and said sheet of material.

* * * * *